US005315754A

United States Patent [19]

Klappert et al.

[11] Patent Number: 5,315,754

[45] Date of Patent: May 31, 1994

[54] METHOD OF MAKING A TRANSFORMER CORE COMPRISING STRIPS OF AMORPHOUS STEEL WRAPPED AROUND THE CORE WINDOW

[75] Inventors: Willi Klappert, Hickory, N.C.; William K. Houser, Greeneville, Tenn.

[73] Assignee: General Electric Company, Malvern, Pa.

[21] Appl. No.: 967,913

[22] Filed: Oct. 28, 1992

Related U.S. Application Data

[63] Continuation of Ser. No. 623,265, Dec. 6, 1990, Pat. No. 5,175,924, which is a continuation of Ser. No. 535,538, Jun. 11, 1990, abandoned.

[51] Int. Cl.[5] ..... H01F 41/02

[52] U.S. Cl. ..... 29/609; 29/738; 336/213; 336/234

[58] Field of Search ..... 29/609, 605, 606, 738; 336/212, 213, 216, 217, 234

[56] References Cited

U.S. PATENT DOCUMENTS

| | | | |
|---|---|---|---|
| 3,049,793 | 8/1962 | Cooper . | |
| 3,328,737 | 6/1967 | Olsen | 336/211 |
| 4,467,632 | 8/1984 | Klappert | 72/147 |
| 4,734,975 | 4/1988 | Ballard et al. | 29/606 |
| 4,741,096 | 5/1988 | Lee et al. | 29/605 |

*Primary Examiner*—Carl E. Hall

*Attorney, Agent, or Firm*—Henry J. Policinski; William Freedman

[57] ABSTRACT

Groups of amorphous steel strips, cut to appropriate length from a composite strip, are stacked in longitudinally-staggered relationship to form packets. The groups are made up by a process that comprises a pre-spooling operation that results in the strips and groups in each packet adhering together, even though dry. The individual packets are fed successively into a belt nester that includes a rotatable arbor and wrapping means that wraps the packets in superposed relationship about the arbor as the arbor rotates, thereby building up a hollow core form. The above-described adhesive effect precludes the strips and groups from shifting longitudinally while the packets are being wrapped about the arbor.

28 Claims, 6 Drawing Sheets

METHOD OF MAKING A TRANSFORMER CORE COMPRISING STRIPS OF AMORPHOUS STEEL WRAPPED AROUND THE CORE WINDOW

This is a continuation of co-pending application Ser. No. 07/623,265 filed on Dec. 6, 1990, which is a continuation of application Ser. No. 07/535,538 filed Jun. 11, 1990, now abandoned.

CROSS-REFERENCE TO RELATED PATENTS AND APPLICATIONS

This invention is related to the subject matter disclosed and claimed in the following patents and patent applications:

Application Ser. No. 463,697—Ballard & Klappert filed Jan. 11, 1990, issued as U.S. Pat. No. 5,093,981.

Application Ser. No. 505,593—Ballard & Klappert filed Apr. 6, 1990, which is the parent of file wrapper continuation application Ser. No. 622,364, filed Dec. 5, 1990, and issued as U.S. Pat. No. 5,050,294.

U.S. Pat. No. 4,734,975—Ballard & Klappert

U.S. Pat. No. 4,741,096—Lee & Ballard

All of these patents and patent applications are incorporated by reference in the present application.

TECHNICAL FIELD

This invention relates to a method of making a core for an electric transformer that comprises a plurality of strips of amorphous steel wrapped in superposed relationship about the window of the core and, more particularly, relates to a method of this type that employs a belt nester for wrapping packets made from groups of such strips about a rotatable arbor that is rotated as the packets are wrapped thereabout.

BACKGROUND

A type of core-making machine that has been used for many years for making transformer cores is the belt nester. Typically, a belt nester comprises a rotatable arbor about which sections of magnetic strip steel of controlled length are wrapped in superposed relationship as the arbor is rotated, thereby building up a core form that increases in diameter as additional strips are wrapped about those previously wrapped. Wrapping of the strips is effected by use of a flexible belt that encircles the arbor and is driven to cause rotation of the arbor and any strips previously wrapped about the arbor. Strips are fed into the belt nester in such a manner that they enter between the arbor and the encircling belt; and as the belt and arbor move together, each entering strip, or group of strips, is forced by the belt to tightly encircle the arbor or any core form already built up upon the arbor. An example of a belt nester of this type is disclosed in U.S. Pat. No. 3,049,793—Cooper.

Belt nesters of the above type have heretofore been used for making cores that comprise strips of amorphous steel that are wrapped about the rotating arbor. Because the amorphous strips are very thin (e.g., typically only about 1 mil in thickness), it is customary and highly desirable to feed them into the belt nester in groups, each group being at least ten strips in thickness. But one problem that is present when a belt nester is used with groups of amorphous steel strips is that during the nesting process the strips tend to slide about within the group and on the rotatable arbor or on the rotating partially-built up core form, and this is a serious problem because these strips must be precisely and predictably located. To overcome this problem, the assignee of the present invention has covered the strips, just prior to belt nesting, with a volatile liquid such as perchloroethylene that is capable of holding the strips together in the manner required for effective belt nesting. The liquid later evaporates. This, however, is not an entirely satisfactory approach because the perchloroethylene is expensive, is environmentally undesirable, and can produce rust or corrosion problems.

OBJECTS

An object of our invention is to provide, for making a transformer core of amorphous steel strips extending about the core window, a method that is capable of being effectively carried out with a belt nester having a rotatable arbor about which are wrapped amorphous steel strips fed into the belt nester in groups.

Another object is to carry out the immediately-preceding object by providing a method that requires no liquid for holding the amorphous steel strips together while they are being wrapped about the arbor.

SUMMARY

In carrying out our invention in one form, we assemble a plurality of packets of amorphous steel strips, each packet being made up of superposed groups of amorphous steel strips and each group being made up of at least one section of multiple-layer amorphous steel strip. The sections of amorphous steel strips are derived by cutting to controlled lengths a composite strip of amorphous steel strip that has been made up by combining multiple-layer thickness strips derived from a plurality of master spools. The multiple-layer thickness strip in each of these master spools is made by a pre-spooling operation in which a pre-spooling machine takes a plurality of mill-wound spools of single layer thickness strip and combines strips from such mill-wound spools to form said multiple-layer thickness strips in said master spools.

We have found that when this process comprising pre-spooling is used for making the aforesaid composite strip, the strips in each section cut from the composite strip, even though essentially dry, adhere to juxtaposed strips almost as if a glue is present between them. This adhesive effect enables us to make up cohesive packets from these sections and to feed such packets into the rotatable-arbor belt nester without the necessity of relying upon the previously-used liquid for holding the strips against displacement while they are being wrapped about the rotatable arbor during the nesting operation.

BRIEF DESCRIPTION OF FIGURES

For a better understanding of the invention, reference may be had to the following description taken in connection with the accompanying drawings, wherein.

DETAILED DESCRIPTION OF EMBODIMENTS

The Packets

Figure 1:
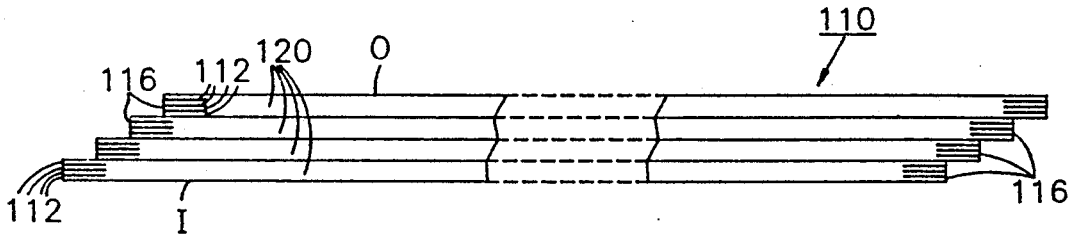
FIG. 1 is an enlarged side elevational view of a packet of amorphous steel strips representative of many such packets that are used in carrying out our method.
Figure 2:
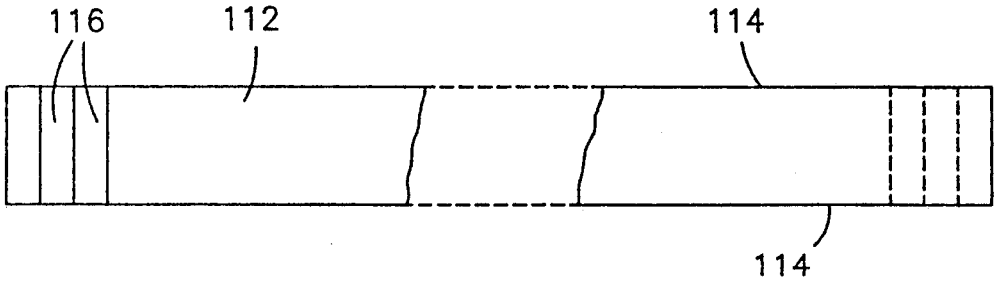
FIG. 2 is a plan, view of the packet shown in FIG. 1.

Referring first to FIGS. 1 and 2, there is shown a packet 110 that is representative of a large number of packets that are used for constructing a transformer core in accordance with the method of our invention. The packet of FIGS. 1 and 2 is formed from many superposed elongated strips 112 of amorphous steel, each having a thickness of only about 1 mil, which is very small in comparison to the 7 to 12 mils typical of the thickness of the grain-oriented silicon steel that is most commonly used for distribution transformer cores. Each strip comprises two lateral edges 114 extending along its length and transversely-extending edges 116 at opposite ends of the strip. The superposed strips are arranged in groups 120 each comprising a large number of strips, e.g., 10 to 36. In each group, the lateral edges 114 of the strips at each side of the strips are substantially aligned, and the transversely-extending edges 116 of the strips at each end of the strips are substantially aligned.

Packet 110 comprises a plurality of superposed groups 120 of strips. In each packet, the lateral edges (114) of all the groups are substantially aligned but the transversely-extending edges (116) of the groups at the ends of the packet are staggered with respect to each other longitudinally of the packet. Within each packet, the ends of successive groups, considered from the inside I to the outside 0 of the packet, overlap at one end of the packet and underlap at the opposite end of the packet. All the packets used in a given transformer core are preferably of the same basic construction and the same width, but the packets (assembled for being successively wrapped about the window of the core) are made of progressively increasing length to accommodate the increasingly greater successive wrapping of packets about its outer periphery. In carrying out the method of our invention, the packets 110 and their components are produced in a special manner that will be described in more detail hereinafter.

The Belt Nester 128

Figure 4:
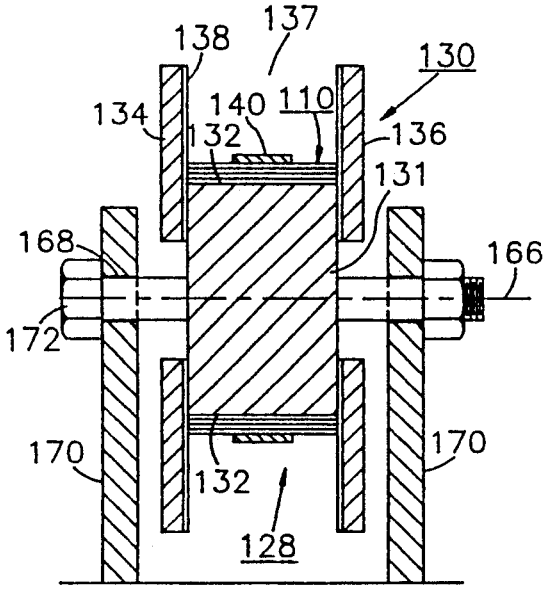
FIG. 4 is a sectional view along the line 4—4 of FIG. 3.
Figure 3:
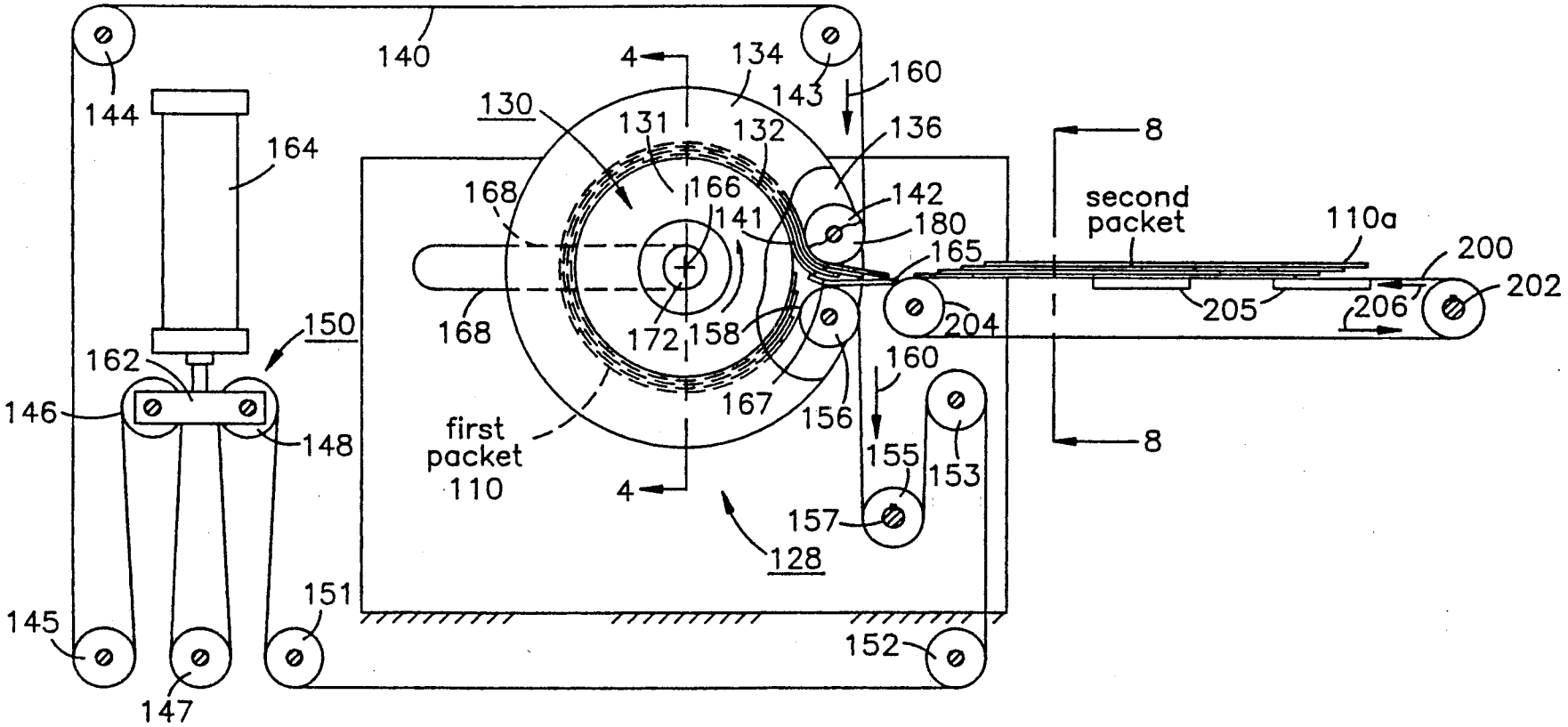
FIG. 3 is a partially, schematic side elevational view of a belt nester used for building up a core form from a plurality of packets of the type depicted in FIGS. 1 and 2. A portion of one of the guide flanges of the belt nester is broken away.

For building up a core form from packets such as shown at 110 in FIGS. 1 and 2, we utilize a type of wrapping machine commonly referred to as a belt nester. Referring to FIGS. 3 and 4, this belt nester, designated 128, comprises a rotatable arbor 130 that comprises a steel hub 131 having a circular outer periphery 132 and two guide flanges 134 and 136 removably attached to the hub at its respective opposite sides. Each guide flange 134 and 136 extends radially outward beyond the circular outer periphery 132 of the hub so that there is a space 137 of U-shaped cross-section present at the outer periphery of the arbor. Preferably, each of the flanges 134 and 136 is made primarily of aluminum, but each flange includes a thin sheet 138 of wear-resistant stainless steel on its inner face adhesively bonded to the remainder of the flange. As will soon be explained, in more detail, a plurality of packets such as shown at hub 131 of the arbor in the space 137 between the flanges 134 and 136. The flanges serve as guides cooperating with the lateral edges 114 of the packets to assure that the packets are tightly wrapped about the outer periphery 132 of the hub with their lateral edges 114 at each side of the packet in substantial alignment.

The wear-resistant coating 138 on each flange serves to protect the flange against wear or other damage from the sharp edges of the amorphous steel strips wrapped within space 137.

For successively wrapping the packets 110 about the hub 131 of the arbor 130, the belt nester 128 employs an endless flexible belt 140 that encircles the hub 131. This belt extends from a first point 141 on the front of the arbor about a first front roller 142, then about three idler rollers 143, 144 and 145, then about rollers 146, 147 and 148 in a belt-tensioning device 150, then about three more idler rollers 151, 152 and 153, then about a motor-driven pulley 155, and then about a second front roller 156 to a second point 158 on the front of the arbor spaced from the first point 141, and then around the hub 131 of the arbor back to the first point 141.

Each of the above described rollers 142, 143, 144, 145, 147, 151, 152, 153 and 156 is suitable mounted for free rotation about its own stationarily-located central axis. The motor-driven pulley 155 is coupled to an electric motor (not shown) through a rotatable drive shaft 157 attached to the pulley and having a stationary axis. When the motor is operated to drive the pulley, the pulley drives the belt 140 in the direction of arrows 160 (FIG. 3).

The belt-tensioning device 150 comprises a pair of rollers 146 and 148 that are mounted on a horizontally-extending cross-head 162 that is suitably guided for vertical motion and biased vertically upward by a spring device 164. Also included within the belt-tensioning device is a stationary idler roller 147. The belt 140 extends from the idler roller 145 over one of the movable rollers 146, then underneath the idler roller 147, then over the other movable roller 148 and then underneath idler roller 152. As the core form on the arbor is built up, greater effective belt length is required for the belt 140 to encircle the increasingly larger periphery of the core form; and the movable rollers 146 and 148 move downwardly against the bias of spring device 164 to make available this greater effective belt length. The spring device 164 maintains a substantially constant tension on the belt 140 as the core form is built up on the arbor.

Each packet 110 that is to be wrapped about the arbor is fed onto the arbor hub along the upper surface of a stationary guide plate 165 that extends between the front rollers 142 and 156. This guide plate has a front portion 167 that is curved gradually upwardly so that the leading end of the packet entering from the right is directed upwardly into the space between the upper run of the belt 140 and the underlying peripheral portion of the hub of the arbor. When the belt contacts the leading end of the entering packet, the belt drive is started and the leading end of the packet is gripped between the belt and the hub (or any core form then present on the hub). As the belt moves in a counterclockwise direction about the axis 166 of the arbor, it drives the arbor counterclockwise about this axis, carrying the leading end of the packet counterclockwise about the axis 166. As the leading end of the packet moves in this manner, more and more of the remaining length of the packet enters the space between the belt and the hub and is progressively wrapped about the hub. This action continues until the trailing end of the packet is wrapped. The packet is of such length that its trailing end overlaps its leading end, thereby producing a lap joint between opposite ends of each group in the packet. The leading edge of each group that is laid down after the first (or radially-innermost) group is positioned closely adjacent the trailing edge of the immediately-preceding group. Accordingly, there are formed between the ends of each packet distributed lap joints, sometimes referred to also as step lap joints.

FIG. 3 depicts the belt nester after its arbor 132 has been rotated through almost a single revolution to almost complete wrapping of a first packet 110 about the arbor hub. A second packet is depicted at 110*a* in a position where it is in readiness to be fed into the belt nester to be wrapped about the first packet after wrapping of the first packet is completed.

The arbor must be rotated slightly more than one revolution (i.e., a short distance into a second revolution) in order to produce the desired overlap at the packet joint. To restore the arbor to a position to arbor is completed, and then a new packet (e.g., 110*a* of FIG. 3) is fed into the belt nester in the same manner as described above and is wrapped about the outer periphery of the immediately-preceding wrapped packet in the same manner as described above.

Additional packets are successively wrapped about the outer periphery of the core form in the same manner until a core form of the desired thickness, or build, has been developed. The additional packets that are wrapped after the first two are so positioned that their lap joints are located generally in radial alignment with the lap joints of the first two packets. The joint region of the full-thickness core has a progressively increasing length proceeding from the window to the outer periphery of the core form, just as shown in FIG. 2 of the aforesaid U.S. Pat. No. 4,741,096—Lee and Ballard.

Figure 4A:
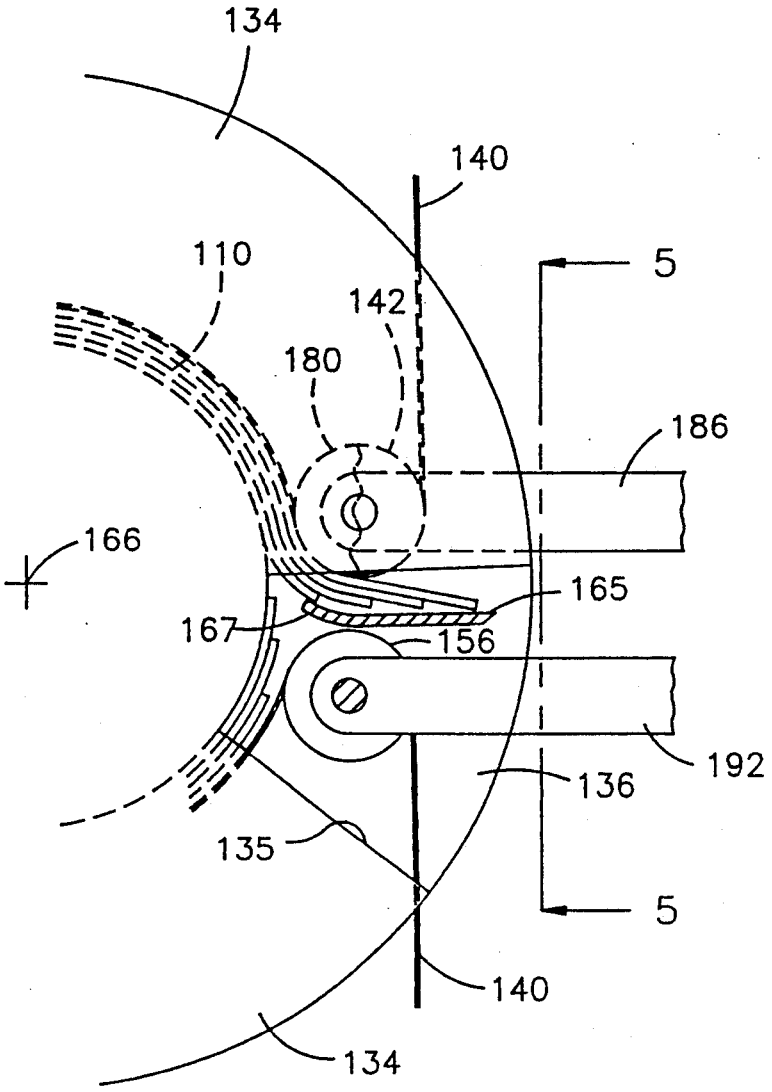
FIG. 4A is an enlarged view of a portion of FIG. 3 without any breaking away of the guide flange.

As shown in FIG. 4A, one of the flanges (134) on the arbor has a gap or window 135 therein angularly registering with the joint region, and through this window the operator of the belt nester 128 can readily view the joint developed for each packet. If the amount of overlap in the joint is not within prescribed limits, he initiates certain adjustments in the strip-length control means (soon to be described) which cause the strip-length control means to appropriately adjust the length of subsequently-cut strips and thus the groups and packets assembled from such strips.

As the core form is built up on the hub 131 of the arbor, the axis 166 of the arbor is forced to move to the left, as viewed in FIG. 3, thus providing room for new packets successively fed onto the outer periphery of the core form between this outer periphery and the front roller 142. This leftward movement of the arbor axis is made possible by horizontally-extending slots 168 provided in the framework 170 that supports the arbor. The arbor has a horizontally-extending supporting shaft 172 that extends into these slots, and the slots cooperate with this shaft 172 to guide the arbor for the desired horizontal movement. The arbor is biased to the right by the belt-tensioning device 150 supplying tensioning force to the belt 140. But as additional packets 110 are fed into the belt nester 128 to increase the diameter of the core form, the arbor hub 131 is forced away from the front rollers 142 and 156, thus gradually moving horizontally to the left against the rightward bias of the belt-tension. Rightward movement of the arbor by the above-described biasing force is limited by the front rollers 142 and 156, which contact the belt 140 encircling the core form.

As explained under BACKGROUND hereinabove, one of the problems encountered when a belt nester is used with groups of amorphous steel strips is that during the nesting process the strips tend to slide about within the group and on the rotating arbor or on the partially built-up rotating core form. To overcome this problem, applicants, assignee has heretofore covered the strips just prior to belt nesting with a volatile liquid such as perchloroethylene that is capable of holding the strips together sufficiently to permit effective belt nesting. But this approach is not entirely satisfactory because the perchloroethylene is expensive, is environmentally undesirable, and can produce rust or corrosion problems.

FEATURES CONTRIBUTING TO OUR ABILITY TO BELT-NEST ESSENTIALLY DRY AMORPHOUS STEEL SHEETS ON A ROTATING ARBOR

Our invention enables us to effectively belt-nest groups of amorphous steel strips on a rotating arbor without relying upon any perchloroethylene or similar liquid for holding the strips together while they are being wrapped. An important step in enabling us to achieve this objective is that we feed the groups of strips into the belt nester in packets instead of in individual groups. Each packet has enough column strength considered laterally of the packet to enable the guide flanges 134 and 136 of the rotating arbor to edge-guide the packet laterally, acting upon the lateral edges of the packet to force the packet to seat squarely within the U-shaped space 127 at the periphery of the arbor with its lateral edges at each side of the packet in alignment with those of the already-seated packets.

In addition, by wrapping in packets instead of in individual groups, we greatly reduce the number of revolutions that the arbor is required to make in order to wrap the strips of an entire core; and this reduces the likelihood of undesirable displacement of individual strips or groups on the arbor during wrapping of this large number of strips.

Another important step in enabling us to achieve our above objective is that we assemble our packets from groups of strips derived through a pre-spooling process corresponding to that disclosed and claimed in the aforesaid application Ser. No. 505,593—Ballard and Klappert. We have found that when the groups are made by this pre-spooling process, the strips in each group, even though essentially dry, adhere to juxtaposed strips almost as if a glue is present between them. This adhesive effect enables us to make up cohesive groups and cohesive packets from these groups that are both characterized by a greatly reduced tendency for the strips to slide on each other while the packets are being fed into the belt nester 128 and are being wrapped about the arbor 130. More details on the pre-spooling process are provided hereinafter.

Figure 5:
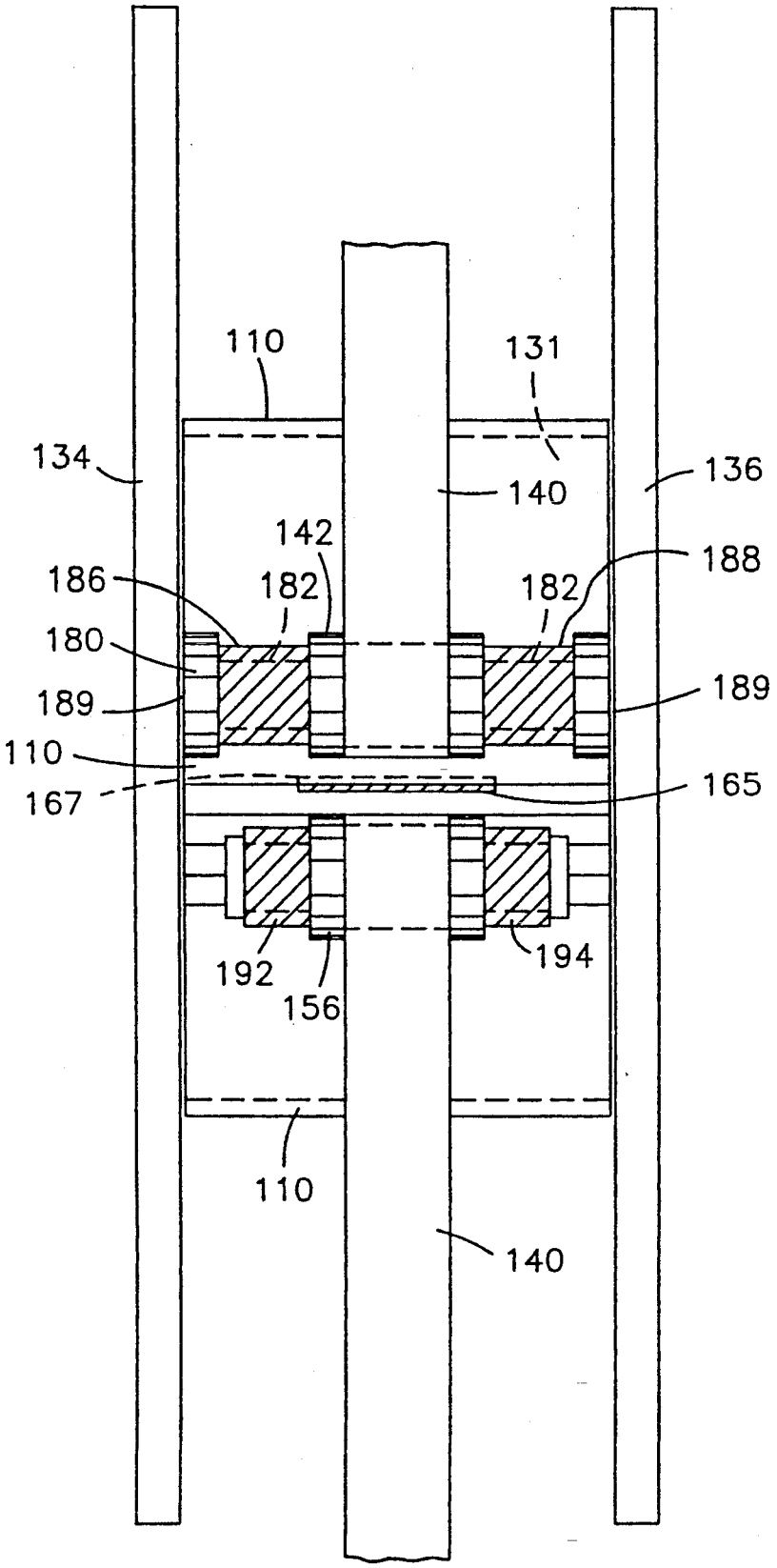
FIG. 5 is a sectional view along the line 5—5 of FIG. 4A.

Another important feature that contributes to our ability to belt-nest the amorphous steel strips on a rotating arbor without relying upon a liquid adhering agent is the tight guidance that we apply to the edge portions of each packet from the time the packet enters the belt nester underneath the upper front roller 142. In this respect, we provide the upper front roller 142 with a pair of edge-guiding infeed rollers 180 that are mounted on the same rotatable shaft 182 as the upper front roller 142, as will best seen in FIG. 5. As the packet enters under the upper front roller 142, the edge portions of the packet tend to bend, or curl, up and, in so doing, to develop a strong tendency to roll up on one or the other of the nesting flanges 134 and 136. The infeed rollers 180 by bearing against the top of the packet edge-portions(and thus exerting force on these portions acting radially inwardly of the arbor hub), and thus maintain a cylindrical configuration of the core form as it is built up. For best results, the spacing (at 189, FIG. 5) between the infeed rollers 180 and their associated flanges 134 and 136 is made quite small in the range of about 0.01 to 0.05 inches. It will be noted from FIGS. 4 and 5 that the belt 140 of the belt-nester has a width that extends for only a small portion of the width of the amorphous sheets and does not extend out to the infeed rollers 180. As a result, the exposed periphery of these rollers is available to bear against the edge portions of the amorphous packet to block these edge portions from climbing up the flanges 134 and 136.

The shaft 182 that carries the infeed rollers 180 and the upper front roller 142 is mounted within axially spaced apart bearings, schematically shown at 186 and 188. These bearings are fixed to the frame 170 by suitably mounting structures (not shown).

MAKING GROUPS OF STRIPS BY A PROCESS THAT COMPRISES PRE-SPOOLING

Figure 6:
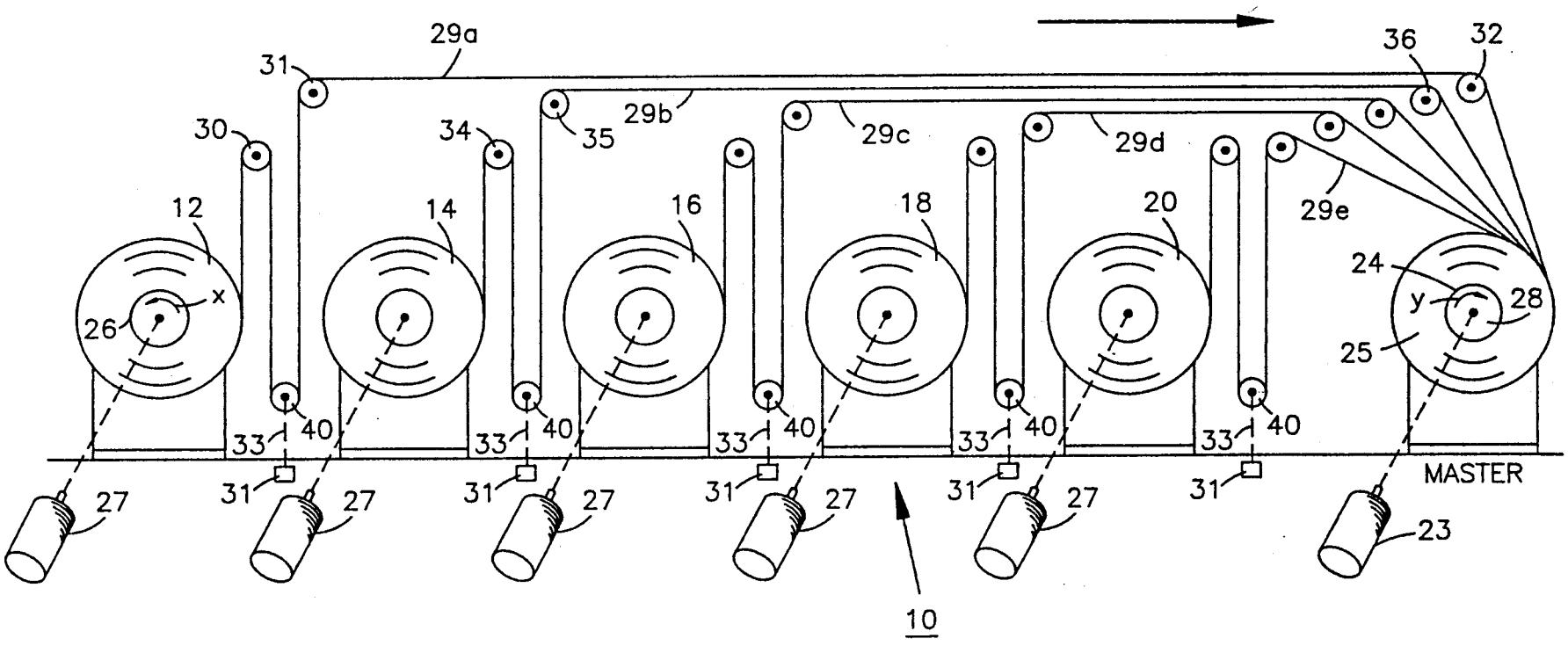
FIG. 6 is a schematic showing of a pre-spooler in which single layer thickness strip is unwound from five starting spools of amorphous steel strip and combined into multi-layer thickness strip that is wound onto a master spool.
Figure 7:
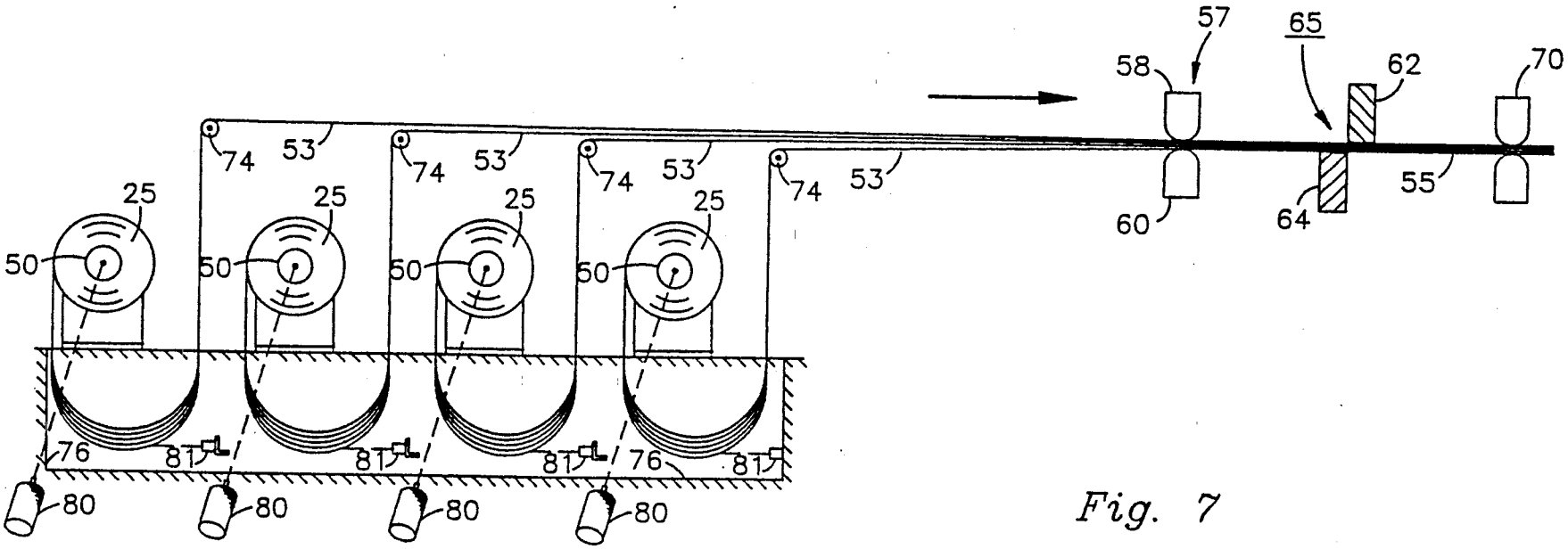
FIG. 7 is a schematic showing of apparatus that combines multiple-layer thickness strip unwound from four master spools into a composite strip that is fed forward and sheared into lengths of composite strip. The apparatus of FIG. 7 receives the master spools from the pre-spooler of FIG. 6.

The above-referred-to process for forming the packets 110 is illustrated in FIGS. 6 and 7, which figures are substantially identical to FIGS. 1 and 2 of the aforesaid application Ser. No. 505,593—Ballard and Klappert.

Referring now to FIG. 6, there is shown a pre-spooler 10 which is adapted to receive five starting spools 12,14, 16, 18, and 20 of amorphous steel strip. These starting spools are spools received from the steel mill, and, accordingly, in each starting spool the strip is of single-layer thickness. The basic purpose of the pre-spooler is to combine the single-layer thickness strips from the starting spools 12, 14, 16, 18, and 20 into multiple-layer thickness strip which is wound onto a master reel 24 as a master spool 25.

Each starting spool is mounted on a fixed-axis rotatable spindle 26 which is coupled to the rotor of an adjustable speed electric motor 27, which motor, when energized drives the spindle 26 in a counterclockwise direction (as indicated by arrow x) to effect unwinding of the associated starting spool. The master reel 24 is mounted on a fixed-axis rotatable spindle 28, which is also coupled to the rotor of an electric motor (23), which normally operates at a substantially constant speed. The latter motor, when energized, drives the spindle 28 in a clockwise direction (as indicated by arrow y) to wind the multiple-layer thickness strip onto the master reel 24. The single-layer thickness strip unwound from each starting spool is directed over a series of guide rollers onto the master reel 24. These single-layer thickness strips are designated 29*a*, 29*b*, 29*c*, 29*d*, and 29*e*.

The guide rollers for the strip from the first starting spool 12 are designated 30, 31, and 32. The guide rollers for the strip from the second starting spool are designated 34, 35, and 36. Corresponding guide rollers are present for the strip unwound from each starting spool.

The single-layer thickness strips from the five starting spools are combined into a multiple-layer thickness strip at the periphery of the master spool 25, and this multiple-layer thickness strip is wound onto the master spool 25 as the spindle 28 of the master reel is driven in a clockwise direction.

For maintaining each single-layer thickness strip under appropriate tension as it is being wound onto the master reel 24, a tensioner roller 40 is provided adjacent each starting spool, acting on a downwardly extending loop 41 in the associated strip located between two of the guide rollers for the strip. Each of these tensioner rollers 40 is mounted in a conventional manner for vertical motion, being gravity biased in a downward direction by a suitable weight. This gravity bias, acting on the strip through roller 40, keeps the strip taut, thus assuring that the multiple-layer thickness strip is smoothly and tightly wound onto the master reel 24. In one embodiment of the invention each tensioner roller 40 is biased downwardly with a weight of about 1.5 pounds for each inch of strip width.

For controlling the unwinding of the starting spools as the multiple-layer thickness strip is being wound onto the master reel 24, a suitable control 31 is provided for each starting-spool electric motor 27. This control 31, which is of a conventional form, operates off a dancer arm, schematically indicated at 33, that moves up and down with the tensioner roller 40. The control 31 causes its associated motor 27 to operate at a speed which depends upon the vertical position of the tensioner roller 40. As the starting spool (e.g., 12) decreases in diameter through unwinding and the master spool 25 increases in diameter through winding, the amount of unwound strip material between the two spools (12 and 25) will tend to decrease, thus shortening the loop 41 and causing the tensioner roller 40 to rise. Control 31 responds to this rise in the position of the tensioner roller 40 by causing the motor 27 to increase its speed, thereby making available more unwound strip material and causing the tensioner roller to descend to its normal vertical position shown. If the tensioner roller descends beyond its normal vertical position shown, the control 31 will cause the motor 27 to reduce its speed, thus shortening loop 41 and returning the tensioner roller 40 to its normal vertical position shown.

It will thus be seen that the tensioner roller 40 and control 31 cooperate (i) to maintain substantial tension on each of the single-layer thickness strips as it is being wound onto the master spool 25 and (ii) to effect unwinding of the starting spools at appropriate speeds without requiring all the unwinding forces to be transmitted through the single-layer thickness strip.

When a master spool 25 of the desired build has been wound on reel 24, the master spool is removed from the drive spindle 26 and put aside for subsequent use. To make possible removal of the master spool, the single-layer thickness strips 29*a–e* are suitably cut at a location adjacent the master spool just prior to removal.

After a first master spool has been built up as above described and then removed from drive spindle 28, additional master spools are built up in the same manner on the drive spindle 28, each being removed upon completion to allow the next one to be built up. Then, four of the master spools 25 are loaded on the four payoff reels 50 of the core-making apparatus shown in FIG. 7.

As further shown in FIG. 7, the multiple-layer thickness strips 53 in the master spools 25 are unwound from their respective master spools and combined into a composite strip 55. This composite strip 55 has a strip thickness equal to the total number of single-layer strips in all of the master spools 25 depicted in FIG. 7. In the illustrated embodiment, each of the multi-layer strips 53 in each of the master spools 25 is five layers in thickness, and, accordingly, the composite strip 55 is 4×5, or 20, layers in thickness.

In unwinding from their master spools 25 and traveling into the location where they are combined to form the composite strip 55, each of the strips 53 of FIG. 2 passes through a pit 76 common to and beneath all the master spools 25 and then over a guide roll 74, where the orientation of each strip is changed from generally vertical to generally horizontal. After passing over the guide rolls 74, the strips are directed in gradually converging relationship into the composite strip 55. The portion of each multiple-layer thickness strip 53 between its associated master spool and its guide roll 74 hangs downwardly in a loop that is located in the pit 76. The weight of the strip 53 in this loop 75 exerts tensile forces on the associated strip 53 as it enters the composite strip 55, thus keeping the strip 53 taut just upstream from the location where it is combined with the other strips, thus reducing the chances for wrinkles and other irregularities in the composite strip.

The composite strip 55 is advanced to the right in FIG. 7 by strip-feeding means 57 comprising a pair of clamping elements 58 and 60. These clamping elements are movable toward and away from each other and are also movable in unison horizontally. In FIG. 7, the clamping elements are shown in their extreme left-hand location and in their minimum spacing position clamping the composite strip 55 on its upper and lower faces. When the clamping elements 58 and 60 move to the right from their position of FIG. 7, they advance the composite strip to the right between the spaced-apart blades 62 and 64 of a shearing device 65.

Assisting the strip-feeding means 57 is additional strip-feeding means 70 located downstream from the blades 62 and 64. When this downstream strip-feeding means 70 becomes effective, the clamping elements 58 and 60 of the first strip-feeding means 57 are separated from each other to release the composite strip 55 and are reset by movement in unison to the left back toward their initial position of FIG. 7. When the strip-feeding means 70 has properly positioned the composite strip by further movement to the right, it also unclamps the composite strip and returns to the left to its initial position of FIG. 7.

For controlling unwinding of the master spools 25 in the apparatus of FIG. 7, each of the payoff reels 50 is coupled to the rotor of an electric motor 80. As the composite strip 55 is fed to the right the motor rotates its associated payoff reel in a counterclockwise direction, making unwound strip material available for the composite strip 55. As noted hereinabove, in the pit 76 beneath each master spool 25 the strip unwound from each master spool hangs down into a loop 75. Each of the individual strips forming the multiple-layer strip hangs down in its own loop, and the vertical spacing between these loops becomes increasingly larger as the associated master spool unwinds. A photoelectric control 81 for each multiple-layer strip 53 is located within, or adjacent, the pit 76 and operates off the lowermost loop 75 of each multiple-layer strip 53 (i) to cause the motor 80 associated with that strip 53 to start and unwind the strip at gradually increasing speed if the loop rises above a predetermined upper limit and (ii) to cause the motor to decelerate to a stop if the loop falls below a predetermined lower limit.

Referring still to FIG. 7, the two strip-feeding means 57 and 70, in moving to the right, cause the composite strip 55 to be intermittently advanced to the right; and this causes the horizontal portions of the multi-layer strips 53 to be advanced intermittently to the right. As the horizontal portions of the strips 53 are thus intermittently advanced to the right, the master spools 25 are unwound by their respective motors 80, making available strip material in the loops 75. From these loops the multi-layer strip material 53 is pulled by feed means 57 and 70 and combined into the composite strip 55. During these operations, the horizontal portion of each of the multi-layer strips 53 is maintained under tension by the weight of the loops 75 in the pit 76.

When the composite strip 55 of FIG. 2, has been advanced to the right to the desired position, it is cut by operation of the shear blades 62 and 64. These shear blades are preferably constructed as shown and claimed in patent application Ser. No. 334,248—Taub et al., filed on Apr. 6, 1989, issued as U.S. Pat. No. 4,942,798 and assigned to the assignee of the present invention.

In operating, the shear blades cut the composite strip 55 into sections of composite strip having the desired lengths. These sections constitute the groups 120 of FIGS. 1 and 2 described hereinabove. The groups 120 are suitably stacked up to form a packet such as the packet 110 of FIGS. 1 and 2. One automated method for forming a packet from such groups is disclosed in the aforesaid application Ser. No. 463,697—Ballard and Klappert, filed Jan. 11, 1990.

We have found that when the pre-spooling process described above is used for making the composite strip 55 from which the sections, or groups, 120 are cut, the strips in each group, even though essentially dry, adhere to juxtaposed strips almost as if a glue is present between them. This adhesive effect enables us to make up cohesive groups and cohesive packets in which the strips adhere to each other in much the same way as if the previously-used perchloroethylene is present.

We believe that this adhesive effect is significantly influenced by the manner in which the surfaces of juxtaposed strips seat upon one another. If these juxtaposed strips were made from adjoining or nearby segments in the same spool of amorphous strip material, the high spots often present along the width of the strip material tend to line up, and this appears to interfere with achieving the adhesive effect between juxtaposed strips that we find so highly desirable. the pre-spooling process provides a high likelihood that these high spots will not line up and interfere with this adhesive effect.

FEEDING THE PACKETS 110 TO THE BELT NEST 28

Each packet, made up and assembled as described above, is suitably transferred to a position atop the upper run of a conveyor belt 200 (FIG. 3). This conveyor belt 200 extends about two spaced-apart pulleys 202 and 204, each rotatable about a fixed axis. Pulley 202 is a driving pulley coupled to the rotor of a suitably controlled electric motor (not shown), and the other pulley 204 is an idler pulley.

Beneath the upper run of the conveyor belt are stationary permanent magnets 205 that assist in transfer of the packet to the belt by providing a biasing force that pulls the packet toward the belt. When the packet is properly seated atop the belt 200, the belt is driven in the direction of arrows 206, and the leading end of the packet moves onto the guide plate 165 and then gradually upwardly to a position between the upper front roller 142 and the hub of the arbor. Then the arbor is rotated counterclockwise as hereinabove described to effect a wrapping operation.

Figure 8:
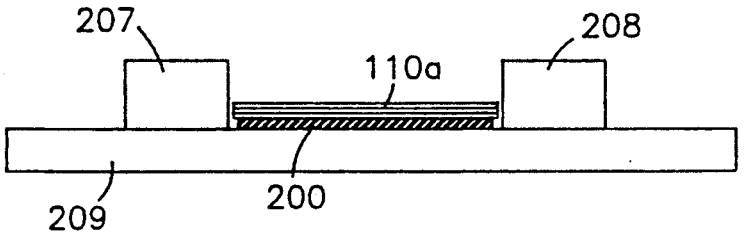
FIG. 8 is a sectional view along the line 8—8 of FIG. 3.

To assure that the packet is properly seated on the belt 200 in the correct position considered laterally of the belt, stationary guides 207 and 208 are provided at opposite sides of the desired lateral position of the packet. Referring to FIG. 8, these guides are mounted on a stationary frame 209 positioned beneath the upper run of the belt. The guiding, or inner, surfaces of the guides 207 are located in substantially the same plane as the inner surface of the nesting flange 134; and the guiding surfaces of guide 208 are located in substantially the same plane as the inner surface of nesting flange 136. These guides help to assure that the packet, when fed into the belt nester 128 by the conveyor belt 200, enters the U-shaped space 137 between the flanges 134 and 136 of the arbor 130 correctly oriented to avoid skewing or telescoping of the packet as it is wrapped about the arbor.

The guides 207 and 208 are suitably adjustably mounted on the stationary frame 209 so as to render the conveyor capable of accommodating strips of different width when it is desired to construct transformer core forms of different width from that of the core form illustrated. For such core forms, a different arbor 130 having an appropriately adjusted spacing between its nesting flanges would also be employed.

STRIP LENGTH CONTROL MEANS

As pointed out hereinabove, the length of each section, or group, 120 cut from the composite strip 55 must be controlled so that the ends of the group overlap by the proper amount when the group is wrapped about the arbor. This length is controlled by controlling the distance that the composite strip 55 is advanced beyond the blades 62, 64 before a cutting operation is effected by the blades. This advancing of the composite strip is performed by strip-feeding means 70 (FIG. 7), which includes suitable means (not shown) for controlling its stroke. After each packet is wrapped around the hub of the belt nester during build-up of the core form, the resultant joint at the ends of the packet is viewed to determine the overlap in the groups of the joint. If this overlap is not within prescribed limits, an error signal is supplied to the control for the strip-advancing means 70 to cause it to appropriately adjust the stroke of the strip-advancing means and thus the length of the next sections of strip to be cut. These viewing and stroke-adjusting operations can be done either by a human operator or by suitable electro-optical control means (not shown). Viewing of the joint takes place through the window 135 in flange 134.

It should be appreciated that it is very advantageous to have the ability to adjust the length of the groups as the wrapping operation proceeds since this allows us to compensate for any unpredictable variations in overlap at the joint that might develop as the wrapping operation proceeds. This advantage is not present in those methods in which all of the strips, before wrapping, are cut to prescribed lengths. A method of this type is exemplified in the aforesaid U.S. Pat. Nos. 4,734,975—Ballard and Klappert and 4,741,096—Lee and Klappert, where the strips are produced by cutting radially through a pre-wound annulus.

While we have shown and described a particular embodiment of our invention, it will be obvious to those skilled in the art that various changes and modifications may be made without departing from our invention in its broader aspects; and we, therefore, intend herein to cover all such changes and of our invention.

What we claim as new and desire to secure by Letters Patent of the United States is:

1. A method of making a transformer core comprising strips of amorphous steel wrapped about a window of the core, comprising the steps of:

(a) providing a plurality of spools of amorphous metal strip in each of which the strip is wound in single-layer thickness, (b) simultaneously unwinding the single-layer thickness strips from said plurality of spools and combining the single-layer thickness strips to form a strip of multiple-layer thickness, (c) winding said multiple-layer thickness strip onto a plurality of master reels in each of which the strip is wound in multiple-layer thickness, (d) unwinding the multiple-layer thickness strips from said master reels and combining said multiple-layer thickness strips into a composite strip that has a thickness in strip layers equal to the sum of the combined multiple-layer thickness strips, (e) cutting said composite strip into a plurality of sections of composite strip, (f) forming from said sections of composite strip groups of strips, each group comprising one or more sections of composite strip, the strips in each group having substantially aligned longitudinally-extending edges and substantially aligned transversely-extending edges at opposite ends of the group, (g) forming from said groups a plurality of packets, each packet comprising a plurality of groups, the groups in each packet having longitudinally-extending edges that are substantially aligned and transversely-extending edges at the ends of the packet that are staggered with respect to each other longitudinally of the packet, and (h) feeding said packets in succession into a belt nester that comprises (i) a rotatable arbor and (ii) wrapping means comprising a belt extending about said arbor for wrapping said packets in superposed relationship about said arbor as the arbor is rotated, thereby building up a core form about said arbor.

2. The method of claim 1 in which the cutting step of paragraph (e) is so controlled that said sections of composite strips are of such lengths that when each of said packets is wrapped about the arbor, opposite ends of each group within said packet meet in overlapping relationship.

3. The method of claim 2 in which each of said packets is formed in such a manner that successive groups therein are staggered by such an amount that when the packet is wrapped about said arbor, each group within the packet radially outward of the innermost group has its leading edge positioned closely adjacent the trailing edge of the immediately-preceding group.

4. The method of claim 3 in which each packet that is wrapped following wrapping of the innermost packet is located at the start of its wrapping operation so that its leading edge overlaps the trailing end of the immediately-preceding packet.

5. The method of claim 1 in which:

(a) said arbor comprises:

(i) a rotatable hub having a periphery on which said packets are wound as the arbor rotates, and (ii) flanges fixed to said hub at axially-opposed sides of the hub and projecting radially outward beyond the periphery of the hub for cooperating with the longitudinally-extending edges of the packets entering the peripheral region of said hub for forcing said entering packets to seat upon said hub with said longitudinally-extending edges substantially aligned, (b) said wrapping means comprises two front rollers engaging said belt and guiding said belt over a path that closely envelopes said hub periphery or any core form built up on said hub periphery, said front rollers being spaced from each other by a gap and being located between said flanges, one front roller engaging said belt as the belt enters said peripheral region of the hub and the other front roller engaging said belt as the belt exits the peripheral region of said hub, and (c) said packets are fed onto the outer periphery of said hub via a path extending through said gap and then between said hub outer periphery and said belt in the region where said belt engages said one front roller.

6. The method of claim 5 in which:

(a) each packet is characterized by a tendency of the portions thereof adjacent said logitudianlly-extending edges to curl in a radially outward direction relative to said hub as the packet passes between said belt and said hub periphery in the region of said one front roller, and (b) force directed radially inwardly of said hub is applied to the outside surface of each packet adjacent the longitudinally-extending edges of the packet as the packet passes between said belt and said hub periphery in the region of said one roller, thereby to counteract said curling tendency.

7. The method of claim 6 in which said radially-inwardly directed force of (b) claim 6 is applied through infeed rollers acting on each packet adjacent said longitudinally-extending edges of the packet.

8. The method of claim 6 in which said radially-inwardly directed force of (b) claim 6 is applied through infeed rollers coupled to said one front roller and acting on each packet adjacent said longitudinally-extending edges of the packet.

9. The method of claim 8 in which:

(a) said belt has a width substantially less than the width of each packet, (b) said belt engages each packet centrally of the packet width, and (c) said infeed rollers are located laterally outward of said belt and closely adjacent said flanges.

10. The method of claim 9 in which the spacing between each of said infeed rollers and the flanges thereadjacent is in the range of about 0.01 to about 0.05 inches.

11. A method of making a transformer core comprising strips of amorphous steel wrapped about a window of the core, comprising the steps of:

(a) providing a plurality of reels of multiple-layer amorphous steel strip on each of which the strip is wound in multiple-layer thickness, (b) unwinding the multiple-layer thickness strips from said reels and combining said multiple-layer thickness strips into a composite strip that has a thickness in strip layers equal to the sum of the combined multiple-layer thickness strips, (c) cutting said composite strip into a plurality of sections of composite strip, (d) forming from said sections of composite strip groups of strips, each group comprising one or more sections of composite strip, the strips in each group having substantially aligned longitudinally-extending edges and substantially aligned transversely-extending edges at opposite ends of the group, (e) forming from said groups a plurality of packets, each packet comprising a plurality of groups, the groups in each packet having longitudinally-extending edges that are substantially aligned and transversely-extending edges at the ends of the packet that are staggered with respect to each other longitudinally of the packet, and (f) feeding said packets in succession into a belt nester that comprises (i) a rotatable arbor and (ii) wrapping means comprising a belt extending about said arbor for wrapping said packets in superposed relationship about said arbor as the arbor is rotated, thereby building up a core form about said arbor.

12. The method of claim 11 in which:

(a) said arbor comprises:

(i) a rotatable hub having a periphery on which said packets are wound as the arbor rotates, and (ii) flanges fixed to said hub at axially-opposed sides of the hub and projecting radially outward beyond the periphery of the hub for cooperating with the longitudinally-extending edges of the packets entering the peripheral regions of said hub for forcing said entering packets to seat upon said hub with said longitudinally-extending edges substantially aligned, (b) said wrapping means comprises two front rollers engaging said belt and guiding said belt over a path that closely envelopes said hub periphery or any core form built up on said hub periphery, said front rollers being spaced from each other by a gap and being located between said flanges, one front roller engaging said belt as the belt enters said peripheral region of the hub and the other front roller engaging said belt as the belt exits the peripheral region of said hub, and (c) said packets are fed onto the outer periphery of said hub via a path extending through said gap and then between said hub outer periphery and said belt in the region where said belt engages said one front roller.

13. The method of claim 12 in which:

(a) each packet is characterized by a tendency of the portions thereof adjacent said longitudinally-extending edges to curl in a radially outward direction relative to said hub as the packet passes between said belt and said hub periphery in the region of said one front roller, and (b) force directed radially inwardly of said hub is applied to the outside surface of each packet adjacent the longitudinally-extending edges of the packet as the packet passes between said belt and said hub periphery in the region of said one roller, thereby to counteract said curling tendency.

14. The method of claim 13 in which said radially-inwardly directed force of (b) claim 13 is applied through infeed rollers acting on each packet adjacent said longitudinally-extending edges of the packet.

15. The method of claim 13 in which said radially-inwardly directed force of (b) claim 13 is applied through infeed rollers coupled to said one front roller and acting on each packet adjacent said longitudinally-extending edges of the packet.

16. The method of claim 15 in which:

(a) said belt has a width substantially less than the width of each packet, (b) said belt engages each packet centrally of the packet width, and (c) said infeed rollers are located laterally outward of said belt and closely adjacent said flanges.

17. The method of claim 16 in which the spacing between each of said infeed rollers and the flanges thereadjacent is in the range of about 0.01 to about 0.05 inches.

18. A method of making a transformer core comprising strips of amorphous steel wrapped about the window of the core, comprising the steps of:

(a) forming a composite strip comprising many layers of superposed amorphous steel strip, (b) cutting said composite strip into a plurality of multi-layer sections of composite strip, (c) forming from said sections of composite strip groups of strips, each group comprising one or more sections of composite strips, the strip in each group having substantially aligned longitudinally-extending edges and substantially aligned transversely-extending edges at opposite ends of the group, (d) forming from said groups a plurality of packets, each packet comprising a plurality of groups, the groups in each packet having longitudinally-extending edges that are substantially aligned and transversely-extending edges at the ends of the packet that are staggered with respect to each other longitudinally of the packet, and (e) feeding said packets in succession into a belt nester that comprises (i) a rotatable arbor and (ii) wrapping means comprising a belt extending about said arbor for wrapping said packets in superposed relationship about said arbor as the arbor is rotated, thereby building up a core form about said arbor.

19. The method of claim 18 in which said composite strip is formed by:

(a) providing a plurality of reels of amorphous steel strip, and (b) unwinding the strips from said reels and combining the unwound strips into said composite strip in such a manner that juxtaposed strips in the composite strip are from different reels.

20. The method of claim 18 in which:

(a) said arbor comprises:

(i) a rotatable hub having a periphery on which said packets are wound as the arbor rotates, and (ii) flanges fixed to said hub at axially-opposed sides of the hub and projecting radially outward beyond the periphery of the hub for cooperating with the longitudinally-extending edges of the packets entering the peripheral region of said hub for forcing said entering packets to seat upon said hub with said longitudinally-extending edges substantially aligned, (b) said wrapping means comprises two front rollers engaging said belt and guiding said belt over a path that closely envelopes said hub periphery or any core form built up on said hub periphery, said front rollers being spaced from each other by a gap and being located between said flanges, one front roller engaging said belt as the belt enters said peripheral region of the hub and other other front roller engaging said belt as the belt exits the peripheral region of said hub, and (c) said packets are fed onto the outer periphery of said hub via a path extending through said gap and then between said hub outer periphery and said belt in the region where said belt engages said one front roller.

21. The method of claim 20 in which:

(a) each packet is characterized by a tendency of the portions thereof adjacent said longitudinally-extending edges to curl in a radially outward direction relative to said hub as the packet passes between said belt and said hub periphery in the region of said one front roller, and (b) force directed radially inwardly of said hub is applied to the outside surface of each packet adjacent the longitudinally-extending edges of the packet as the packet passes between said belt and said hub periphery in the region of said one roller, thereby to counteract said curling tendency.

22. The method of claim 21 in which said radially-inwardly directed force of (b) claim 21 is applied through infeed rollers acting on each packet adjacent said longitudinally-extending edges of the packet.

23. The method of claim 21 in which said radially-inwardly directed force of (b) claim 21 is applied through infeed rollers coupled to said one front roller and acting on each packet adjacent said longitudinally-extending edges of the packet.

24. The method of claim 23 is which:

(a) said belt has a width substantially less than the width of each packet, (b) said belt engages each packet centrally of the packet width, and (c) said infeed rollers are located laterally outward of said belt and closely adjacent said flanges.

25. The method of claim 24 in which the spacing between each of said infeed rollers and the flanges thereadjacent is in the range of about 0.01 to about 0.05 inches.

26. The method of claim 18 in which said groups of strips are kept essentially dry prior to their being wrapped about said arbor by said wrapping means.

27. A method of making a transformer core comprising strips of amorphous steel wrapped about the window of the core, comprising the steps of:

(a) providing a plurality of reels of amorphous steel strip, (b) unwinding the strips from said reels and combining the unwound strips into a composite strip comprising many layers of superposed amorphous steel strip in such a manner that juxtaposed strips in the composite strip are from different reels, (c) cutting said composite strip into a plurality of multi-layer sections of composite strip, (d) forming from said sections of composite strip groups of strips, each group comprising one or more sections of composite strip, the strips in each group having substantially aligned longitudinally-extending edges and substantially aligned transversely-extending edges at opposite ends of the group, (e) feeding said groups while essentially dry and without bonding material between the strips of said groups into a belt nester that comprises (i) a rotatable arbor and (ii) wrapping means comprising a belt extending about said arbor for wrapping said groups in superposed relationship about said arbor as the arbor is rotated, thereby building up a core form about said arbor, and in which said groups of strips are kept essentially dry prior to their being wrapped about said arbor by said wrapping means.

28. A method of making a transformer core comprising strips of amorphous steel wrapped about the window of the core, comprising the steps of:

(a) providing a plurality of reels of amorphous steel strip, (b) unwinding the strips from said reels and combining the unwound strips into a composite strip comprising many layers of superposed amorphous steel strip in such a manner that juxtaposed strips in the composite strip are from different reels, (c) cutting said composite strip into a plurality of multi-layer sections of composite strip, (d) forming from said sections of composite strip groups of strips, each group comprising one or more sections of composite strip, the strips in each group having substantially aligned longitudinally-extending edges and substantially aligned transversely-extending edges at opposite ends of the group, (e) feeding said groups while essentially dry and free of molten metal between said strips into a belt nester that comprises (i) a rotatable arbor and (ii) wrapping means comprising a belt extending about said arbor for wrapping said groups in superposed relationship about said arbor as the arbor is rotated, thereby building up a core form about said arbor, and in which said groups of strips are kept essentially dry and free of molten metal between said strips prior to their being wrapped about said arbor by said wrapping means.

* * * * *